US008443755B2

(12) United States Patent
Jones

(10) Patent No.: US 8,443,755 B2
(45) Date of Patent: May 21, 2013

(54) PAINT APPLICATOR WITH VACUUM REGULATOR

(75) Inventor: Michael B. Jones, Excelsior, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 677 days.

(21) Appl. No.: 12/595,898

(22) PCT Filed: Apr. 3, 2008

(86) PCT No.: PCT/US2008/059208

§ 371 (c)(1),
(2), (4) Date: May 5, 2010

(87) PCT Pub. No.: WO2008/130810

PCT Pub. Date: Oct. 30, 2008

(65) Prior Publication Data

US 2010/0236474 A1 Sep. 23, 2010

Related U.S. Application Data

(60) Provisional application No. 60/912,859, filed on Apr. 19, 2007.

(51) Int. Cl.
*B05B 9/03* (2006.01)
*B05C 11/10* (2006.01)

(52) U.S. Cl.
USPC ..... 118/692; 118/300

(58) Field of Classification Search
USPC ..... 118/300, 692
See application file for complete search history.

(56) References Cited

U.S. PATENT DOCUMENTS

| | | | | |
|---|---|---|---|---|
| 3,163,360 | A * | 12/1964 | McNinch, Jr. et al. | 239/124 |
| 4,160,525 | A | 7/1979 | Wagner | |
| 4,394,863 | A * | 7/1983 | Bartner | 604/90 |
| 4,705,995 | A | 11/1987 | Boll | |
| 4,756,481 | A | 7/1988 | Leuenberger | |
| 4,842,432 | A | 6/1989 | Snetting | |
| 5,141,162 | A | 8/1992 | Gunderson et al. | |
| 5,248,089 | A | 9/1993 | Bekius | |
| 6,273,345 | B1 * | 8/2001 | Kaligian et al. | 239/419.3 |
| 2004/0135003 | A1 * | 7/2004 | Wilting | 239/124 |
| 2007/0278787 | A1 | 12/2007 | Jones et al. | |

OTHER PUBLICATIONS

International Search Report and Written Opinion issued in PCT/US2008/059208, mailed Aug. 18, 2008, 12 pages.
Examiner's Report for Australian Patent Application No. 2008242371, dated Jun. 10, 2010.

(Continued)

*Primary Examiner* — Dah-Wei Yuan
*Assistant Examiner* — Stephen Kitt
(74) *Attorney, Agent, or Firm* — Westman, Champlin & Kelly, P.A.

(57) ABSTRACT

A paint spraying system having a paint reservoir (16) remote from a spray gun (12) of the type which draws paint to the gun using vacuum (6, 7). A paint pump (14) delivers paint under positive pressure to the paint gun and a paint regulator (28) in or associated with the paint gun delivers the paint to the gun as drawn by vacuum by the gun through the regulator. An over-pressure relief valve (70) may be used to limit the positive pressure delivered by the pump. A mechanical switch may be used to select a SPRAY or CLEAN mode for the operation of the paint regulator to allow flushing of the paint regulator.

14 Claims, 21 Drawing Sheets

OTHER PUBLICATIONS

English Translation of First Office Action for Counterpart Chinese Patent Application No. 200880016723.3, dated Nov. 9, 2011.

2nd Chinese Office Action for counterpart Chinese Application No. 200880016723.3, issued Jul. 12, 2012, 3 pages.

* cited by examiner

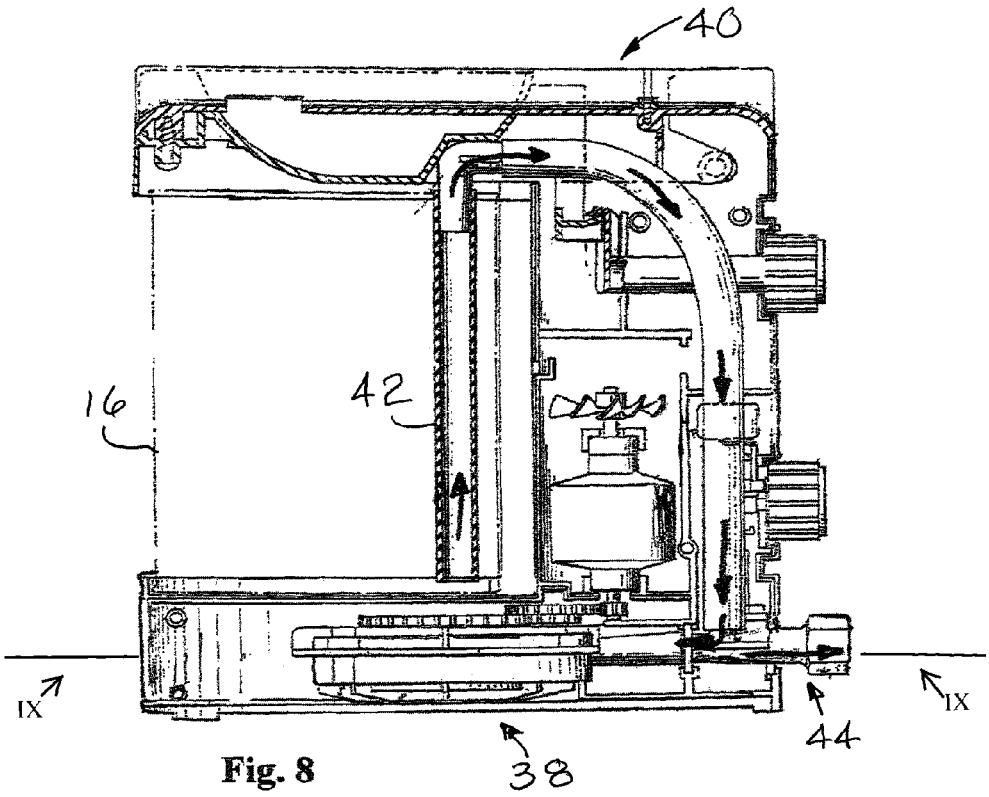
Fig. 8
Fig. 9
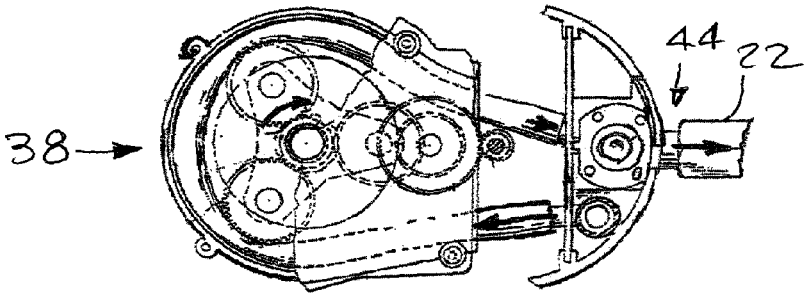

PAINT APPLICATOR WITH VACUUM REGULATOR

CROSS-REFERENCE TO RELATED APPLICATION

This application claims the benefit of Provisional Application No. 60/912,859, filed Apr. 19, 2007, the entire contents of which are expressly incorporated by reference herein.

FIELD OF THE INVENTION

This invention relates to the field of paint sprayers, particularly to electrically powered, hand held sprayers, including those receiving paint from a remote reservoir.

BACKGROUND OF THE INVENTION

Prior art paint sprayers include a cup gun 1 of the type shown in FIG. 1 (taken from U.S. Pat. No. 4,160,525, the entire contents of which are expressly incorporated by reference herein) wherein the paint 3 was held in a reservoir 4 attached to the gun 1. In such devices, paint was drawn from the reservoir or paint cup 4 via a siphon tube 5 (shown in chain lines) into a cylinder or chamber 6 and compressed by a piston rod 7 reciprocating in the cylinder to deliver the paint to a small orifice in a spray tip 8 where it was atomized as it left the gun. A paint return port 9 allows paint that leaks past the piston rod to return to the paint cup 4.

Another prior art U.S. Pat. No. 5,248,089, illustrates a sprayer with a separate paint reservoir, where the paint gun is a conventional cup gun, except with an extended suction set to draw paint from a backpack reservoir. As used herein, "paint" is understood to refer to conventional latex and oil-based paints, as well as other similar coatings, such as, but not limited to stains (with or without opaque pigment), lacquers, varnishes, clear polymer coatings and the like.

SUMMARY OF THE INVENTION

In one aspect, the present invention is a paint spraying system for spraying paint using a spray gun connected to a remote paint reservoir, wherein the system may include a hand-held paint spray gun having a piston reciprocating in a chamber to compress paint drawn into the chamber by vacuum and atomizing the paint drawn into the chamber by driving the paint through a small orifice spray tip. The system also may include a paint reservoir and pump located remote from the paint spray gun and connected thereto by a paint delivery tube, with the pump delivering paint at a pressure greater than zero through the delivery tube. Finally, the system also preferably includes a paint regulator located at the paint spray gun operating to deliver the paint from the paint delivery tube to the chamber at a low level of vacuum.

In another aspect, the pump may deliver paint in the paint delivery tube at a pressure greater than zero and less than about 50 pounds per square inch.

In another aspect, the paint regulator may deliver paint from the paint delivery tube to the chamber at a vacuum between zero and about three inches of mercury.

In still another aspect, the system of the present invention may also include an overpressure regulator connected between the pump and the paint delivery tube acting to limit the pressure in the paint delivery tube to less than about 50 pounds per square inch.

BRIEF DESCRIPTION OF THE DRAWINGS

FIG. 8 is a side view of a peristaltic pump useful in the practice of the present invention.

FIG. 9 is a section view taken along line IX-IX of FIG. 8.

DETAILED DESCRIPTION

Figure 2:
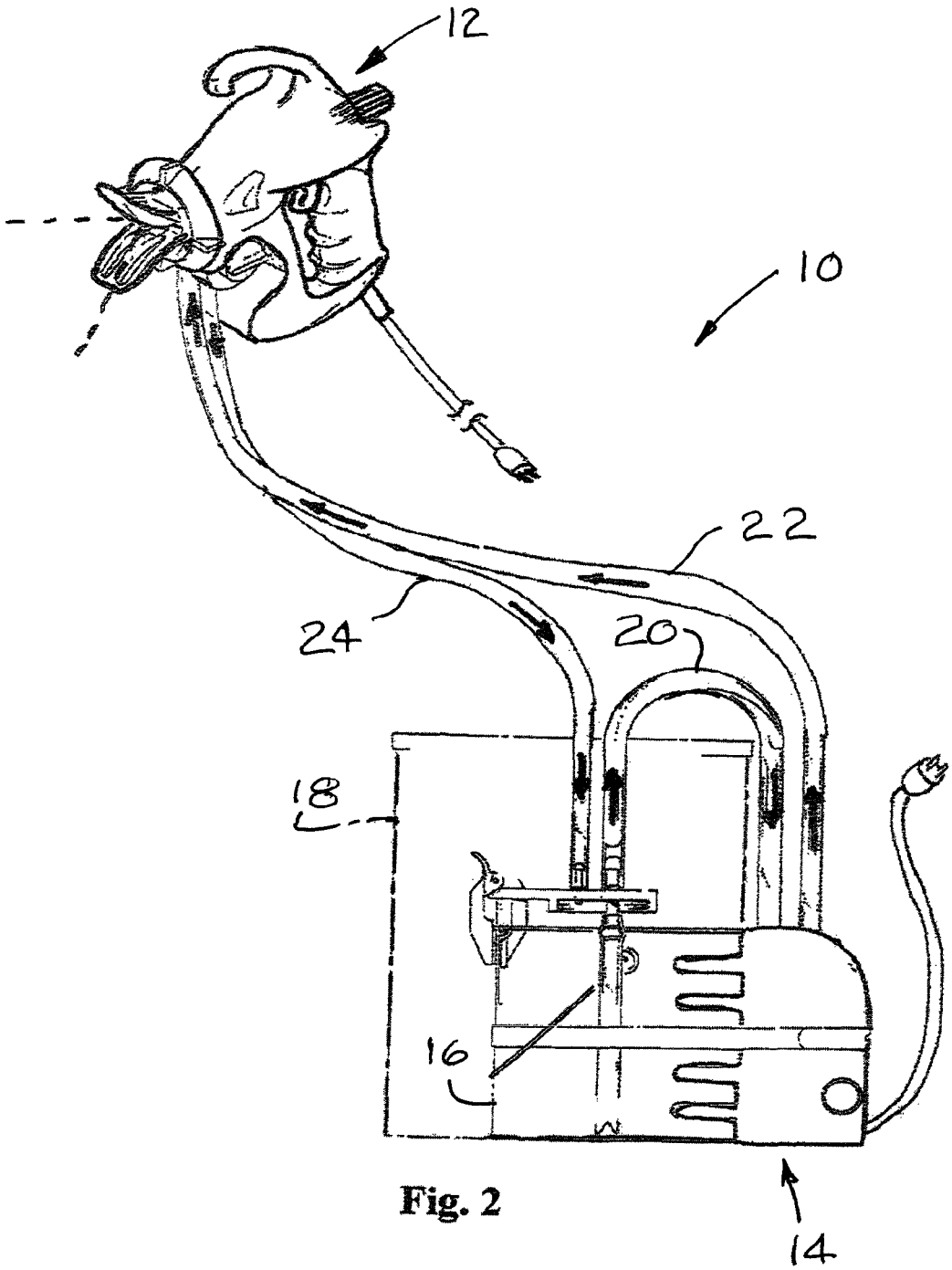
FIG. 2 is a perspective view of a spraying system including a spray gun and remote pump and paint reservoir useful in the practice of the present invention.

FIG. 2 shows a remote feed paint spraying system 10 having a spray gun 12 connected to a feed pump 14. A 1 gallon paint container 16 (or 5 gallon paint container 18) provides paint via a feed tube 20 to the feed pump 14, which may operate at 45-55 PSIG at 0 flow to deliver paint to the gun 12 via a paint delivery tube 22. The spray gun 12 may be generally of the type shown in U.S. Pat. No. 4,160,525, except that the paint cup and siphon tube are omitted from the present system. Alternatively, the spray gun 12 may use the same or similar parts as the paint spray gun in published application US 2007/0278787 A1, Ser. No. 11/421,390, the entire contents of which are hereby expressly incorporated by reference.

Figure 1:
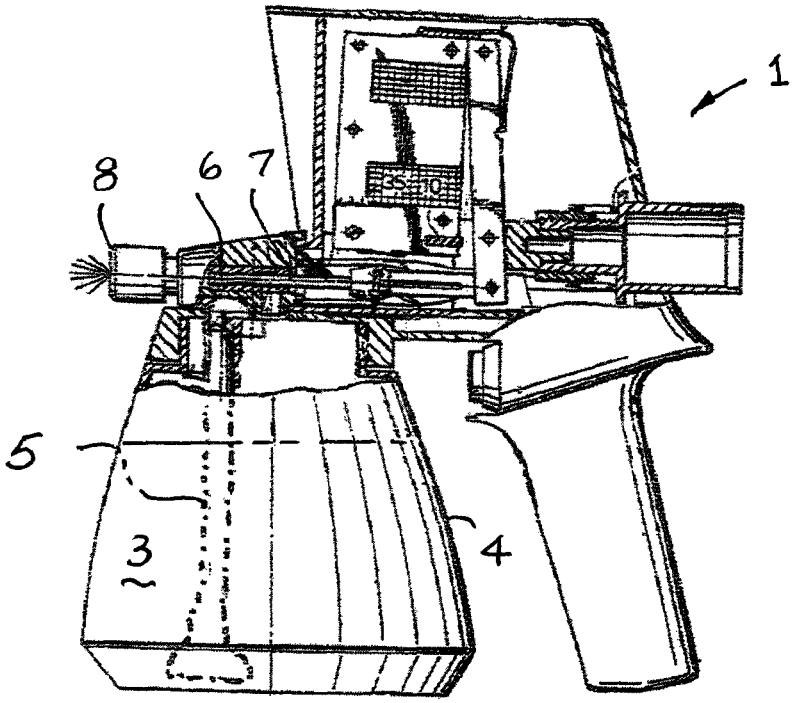
Fig. 1 PRIOR ART
FIG. 1 is a partial elevational and longitudinal sectional view of a prior art paint spray gun.
Figure 3:
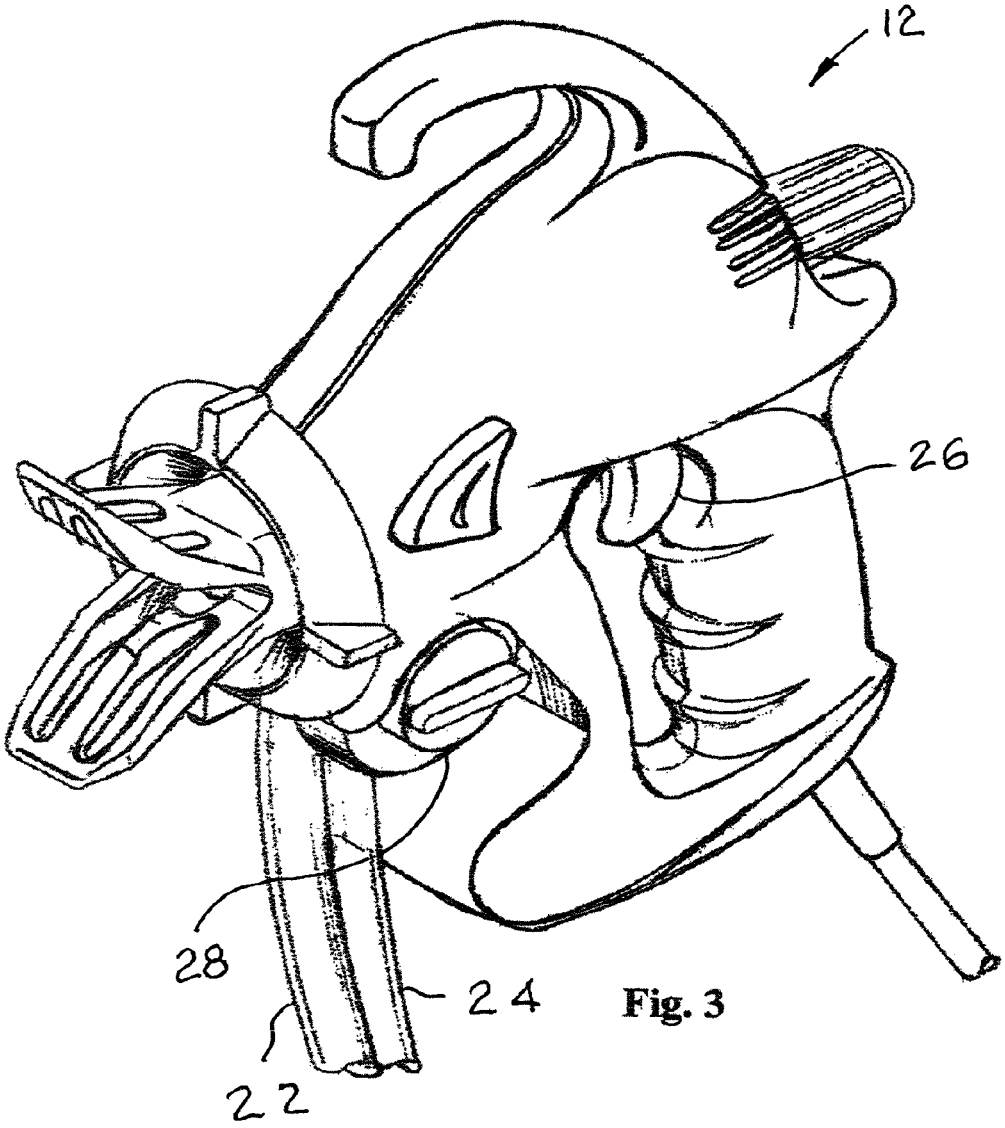
FIG. 3 is a an enlarged perspective view of the spray gun from FIG. 2.

Paint is delivered to the spray gun 12 via the paint delivery tube 22, and a paint return tube 24 returns any paint from the paint return port in the spray gun, as may occur when paint leaks past the piston (normal in operation of a conventional cup gun). A regulator (not shown in FIG. 1, but contained within the housing of the hand-held spray gun) provides paint from the paint delivery tube to the spray gun, as required by the spray gun. FIG. 3 shows an enlarged perspective view of the spray gun 12. Gun has a trigger 26 and a SPRAY/CLEAN switch 28.

Figure 4:
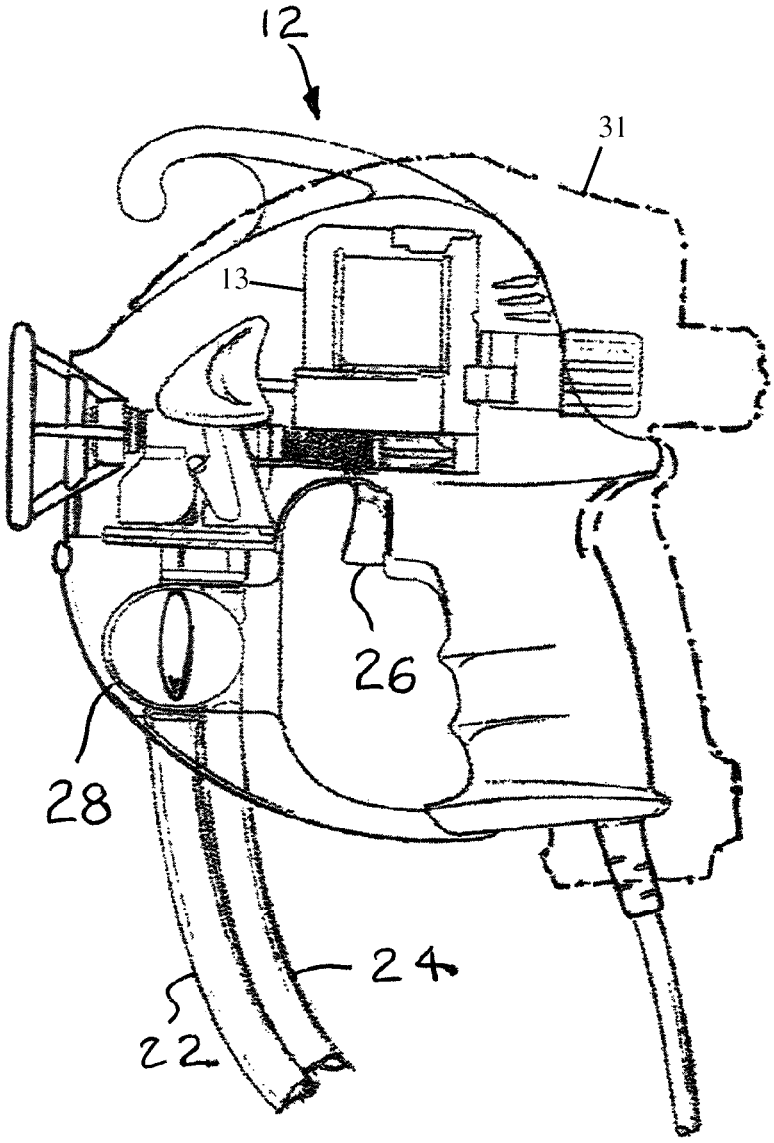
FIG. 4 is a side elevation view of the spray gun from FIG. 2, shown with a partial outline of a conventional cup gun in phantom.

FIG. 4 shows a side elevation view of the spray gun 12 which has an electrical motor, piston rod and return spring, all similar to that shown in the '525 patent and the '787 publication. The outline of the gun from the '787 publication is shown by phantom line 31 for comparison with gun 12. When energized, the electrical motor 13 of gun 12 (having "E", the "I" laminations repetitively pulled towards the "E" laminations) pushes the piston rod left in a compression stroke, towards the spray tip. The return spring moves the piston rod right in a suction stroke when the motor "I" lamination periodically relaxes the force against the piston rod. The piston rod creates a vacuum of about 2 to 2.5 in Hg during the suction stroke, drawing paint into the cylinder to the left of the piston rod. The piston rod pressurizes and atomizes the paint during the compression stroke.

Figure 5:
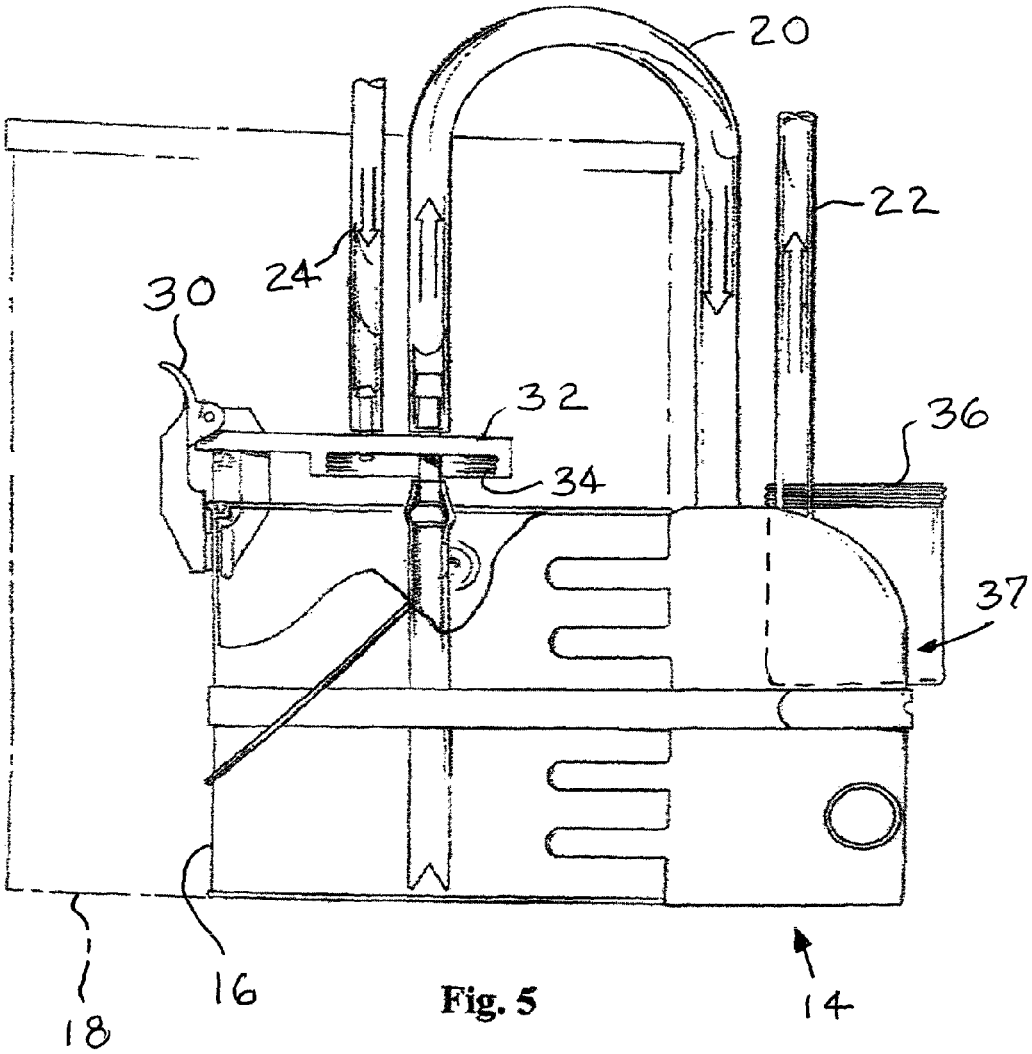
FIG. 5 is an enlarged first side elevation view partly in section of the pump and reservoir from FIG. 2.

FIG. 5 shows an enlarged side elevation view of the feed pump with a feed tube drawing paint from a conventional 1 gallon paint can 16. Alternatively, paint can be drawn from the 5 gallon bucket 18. A spring clamp 30 may be used to hold a tube platform 32 on the paint container to support the feed tube 20 and return tube 24. Tube platform 32 may have internal threads 34 to connect with a cleaning jar 36 when it is desired to flush parts of the system, for example the feed tube 20, pump 14 and paint delivery tube 22. Jar 36 may be retained in a recess 37 in pump 14, as shown in FIGS. 5-7.

Figure 6:
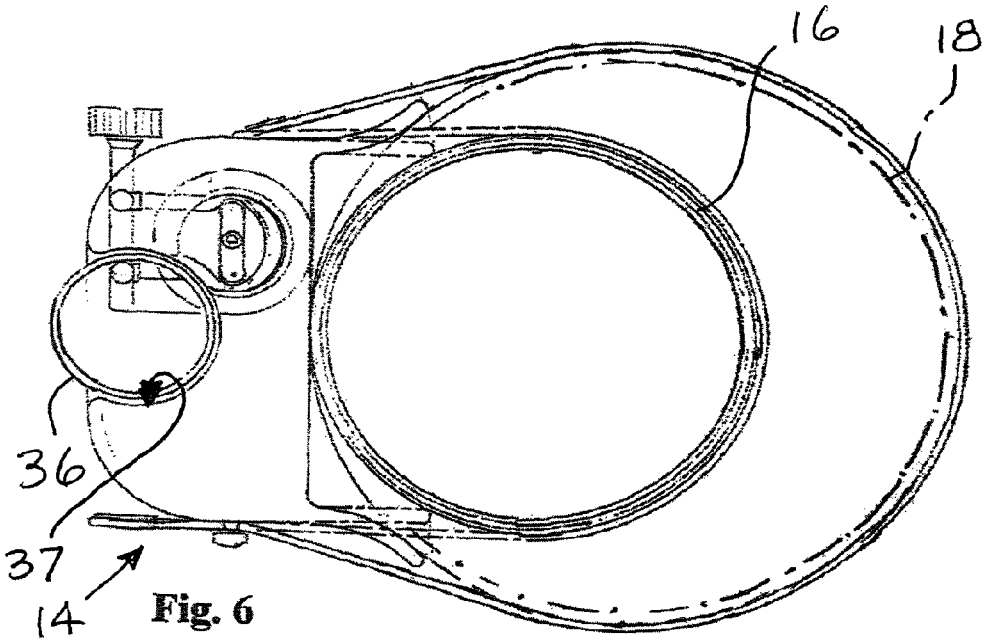
FIG. 6 is a top plan view of the pump and reservoir from FIG. 2.
Figure 7:
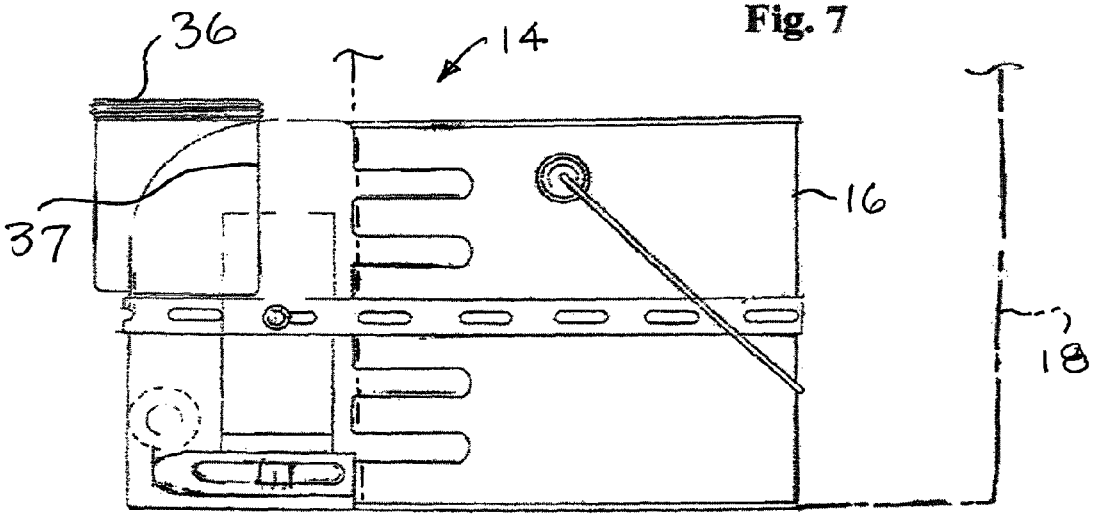
FIG. 7 is a second side elevation view of the pump from FIG. 2.

FIG. 6 shows a top view and FIG. 7 shows a side view of the feed pump 14, which may include a peristaltic pump 38. One embodiment of such a peristaltic pump 38 is shown in U.S. Pat. No. 4,842,432, the entire contents of which are hereby expressly incorporated. FIGS. 8 and 9 correspond to FIGS. 2 and 3 of the '432 patent and illustrate a side and top view of the peristaltic pump assembly 40 useful as pump 14 in the practice of the present invention. Assembly 40 includes a feed tube 42 drawing paint from a one gallon container 16 and delivering the paint to the peristaltic pump 38 which delivers the paint to an outlet 44 connected to the paint delivery tube 22.

Figure 10:
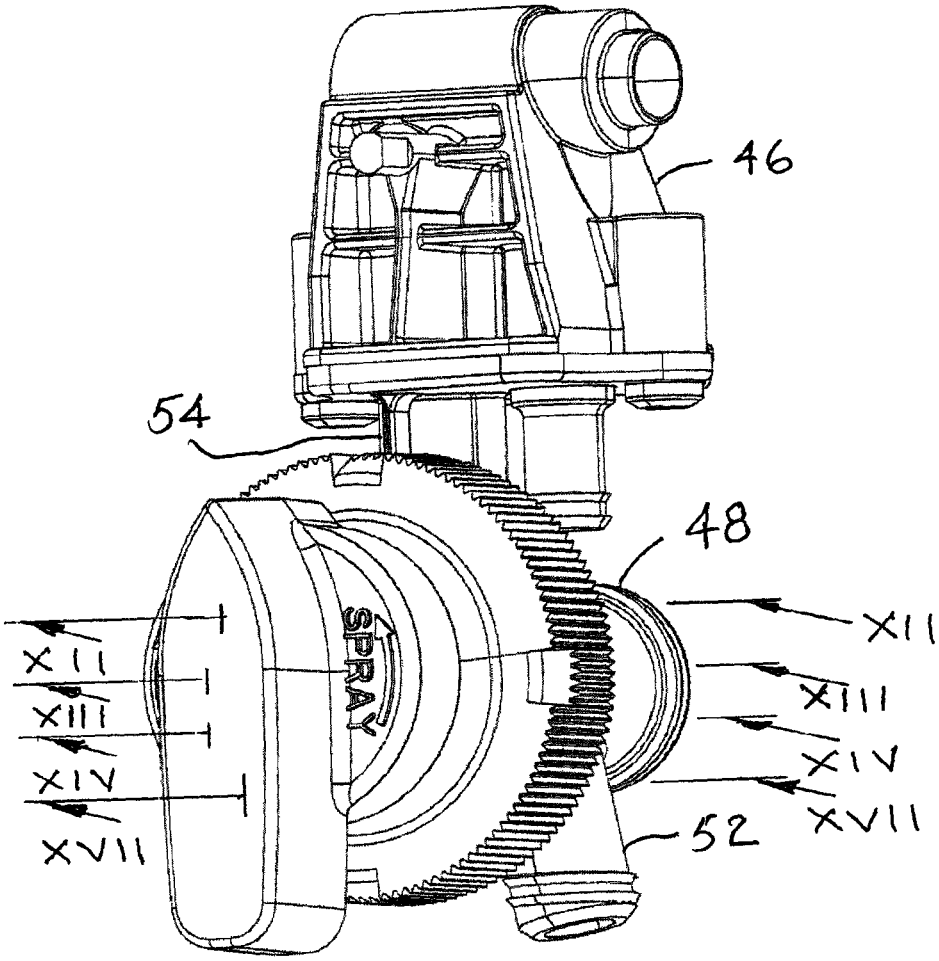
FIG. 10 is perspective view of a piston rod housing and paint regulator useful in the practice of the present invention.
Figure 11:
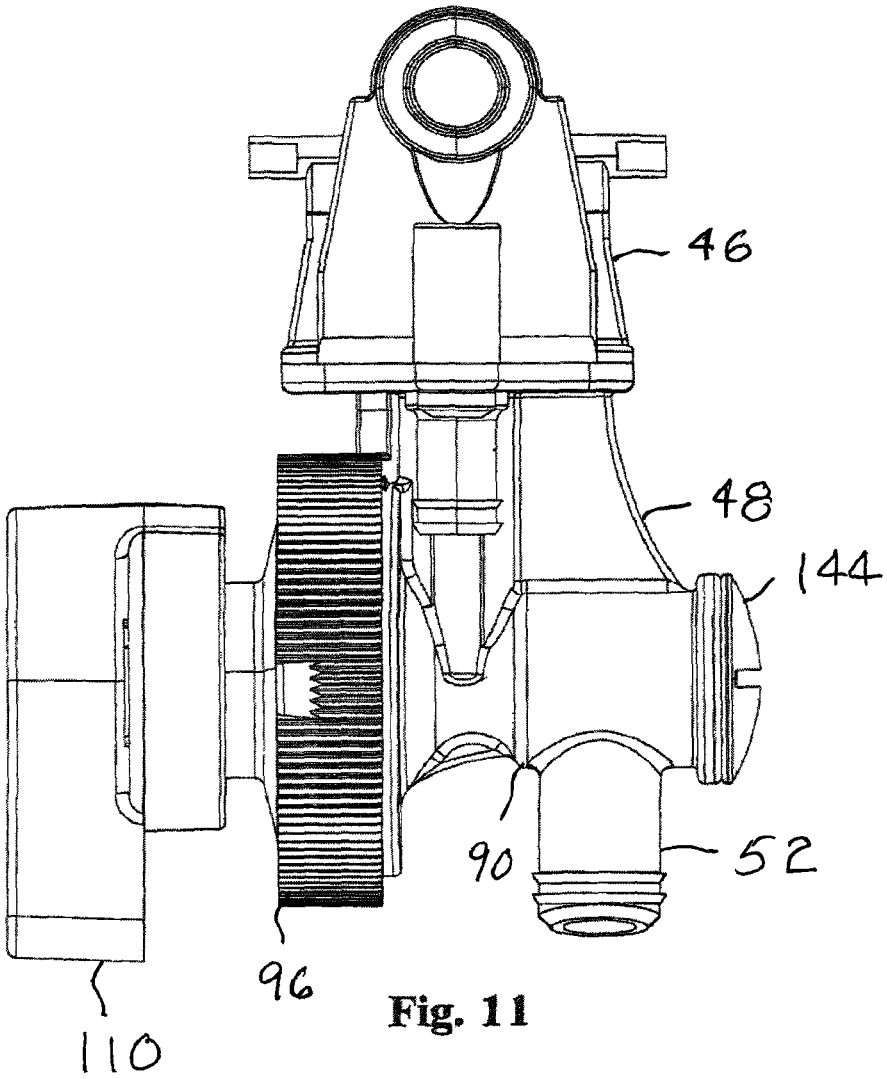
FIG. 11 is a side view of the apparatus shown in FIG. 10.
Figure 12:
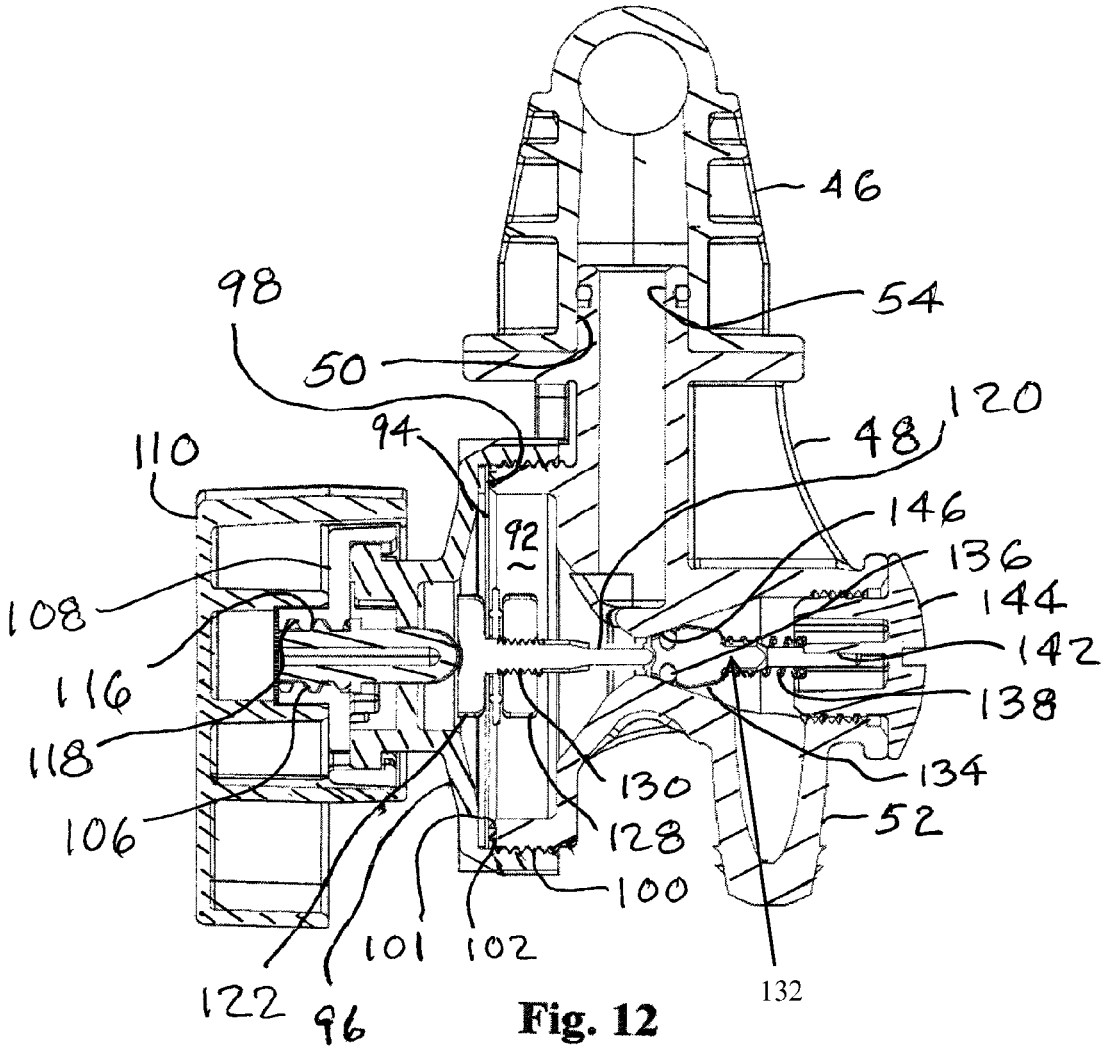
FIG. 12 is a first vertical section view taken along a plane indicated by line XXII-XXII of the apparatus shown in FIG. 10, with parts in a first position corresponding to a SPRAY mode with no vacuum demand on the regulator.

FIG. 10 shows a perspective view of a piston rod housing 46 and a paint regulator 48 (located in the spray gun 12). FIG. 11 shows a section view of the regulator 48. It has been found that delivering paint under pressure to an inlet 50 of the piston rod housing 46 interferes with proper atomization of paint. The regulator 48 allows paint pressure to vary at an input 52 of the regulator 48 (connected by the paint delivery tube 22 to the feed pump outlet 44), while maintaining a 2-4 in Hg vacuum at a regulator outlet 54, which is connected to the inlet 50 of the piston rod housing 46 (it being understood that in the practice of the present invention the regulator 48 replaces the siphon tube of a conventional cup gun, see, e.g., FIG. 1). This operation allows the spray gun 12 to function in a manner to provide an atomized paint pattern similar to the operation of a conventional cup gun 1.

Referring now to FIGS. 11-17, various views of the parts and operation of the paint regulator 48 may be seen along with the piston rod housing 46. Regulator 48 preferably includes a housing 90. Housing 90 has a diaphragm chamber 92 containing a diaphragm 94 made of fabric reinforced nylon, nitrile or Buna-N rubber. Chamber 92 is closed by a diaphragm cover 96. A slip ring 98, preferably made of Delrin or HDPE polymer prevents twisting the diaphragm 94 when the cover 96 is screwed on the threads 100 surrounding the diaphragm chamber 92. Diaphragm 94 is preferably sealed at its periphery by a continuous triangular cross section lip 101, and is retained against radial inward pulling forces by an interrupted lip forming teeth 102. Each of lips 101 and 102 are preferably "saw-toothed" in cross section to positively engage the diaphragm 94.

Regulator 48 also includes a pressure finger 106, an adjusting ring 108 and a knob 110. Pressure finger 106 has a non-circular cross section region 112 (which is preferably square) passing through a corresponding non-circular (preferably square) cross section aperture 114. Pressure finger 106 also has a threaded portion 116 interengaged with mating threads 118 on the adjusting ring 108. A stem 120 having an enlarged head 122 passes through a central aperture in diaphragm 94 in an air tight manner. A washer 124 having a circumferential rib 126 is urged against diaphragm 94 by a nut 128 received on a threaded portion 130 of the stem 120 to insure the air tight integrity between the stem 120 and diaphragm 94.

Regulator 48 also includes a tapered stopper 132 having a back relief 134 and an O-ring 136. A spring 138 is received on an extension 140 of the stopper 132 and guided by a plurality of longitudinal extending, radially inwardly directed fingers 142 on a cap nut 144. It is to be understood that O-ring 136 seals the tapered stopper 132 against a throat 146 of the regulator 48 when urged toward the throat 146 by spring 138 acting against cap nut 144. Another O-ring 148 seals the outlet 54 of the regulator 48 against the inlet 50 of piston rod housing 46.

Figure 18:
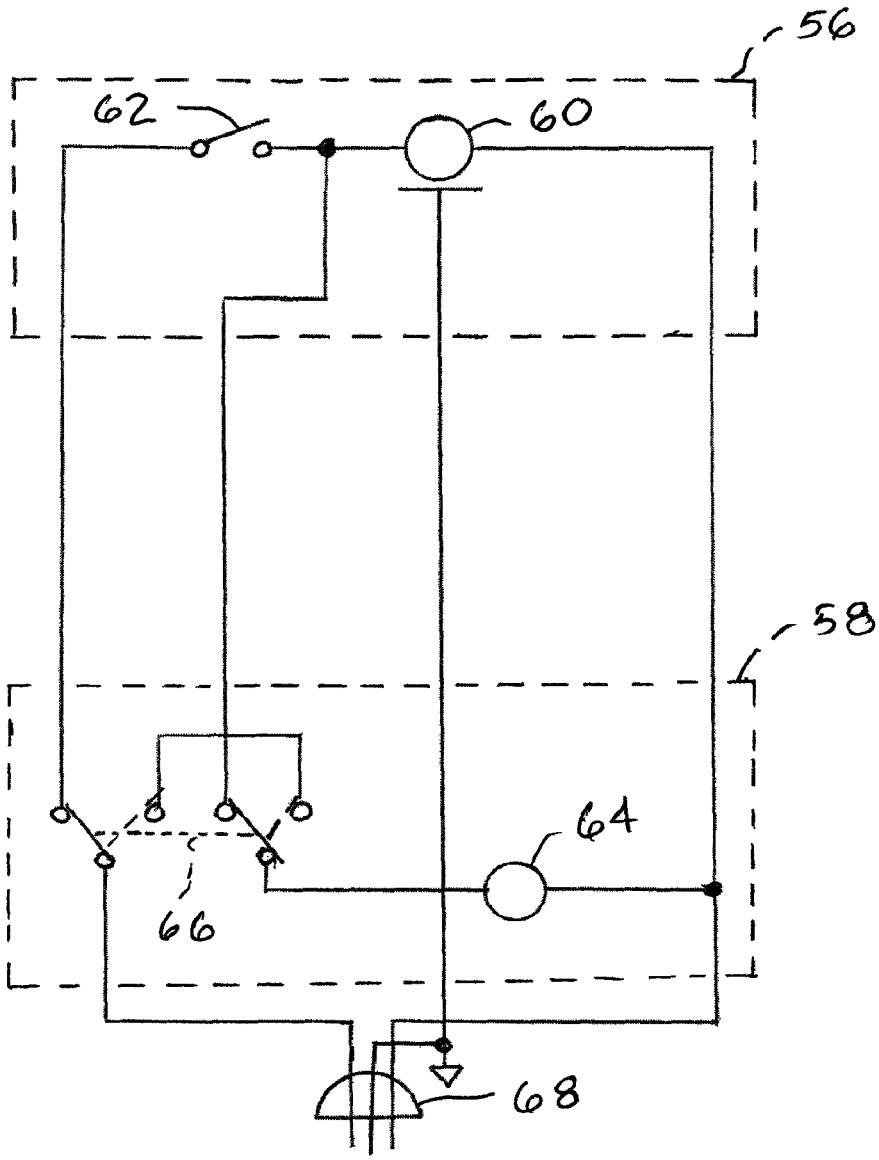
FIG. 18 is an electrical schematic for the system of FIG. 2.
Figure 19:
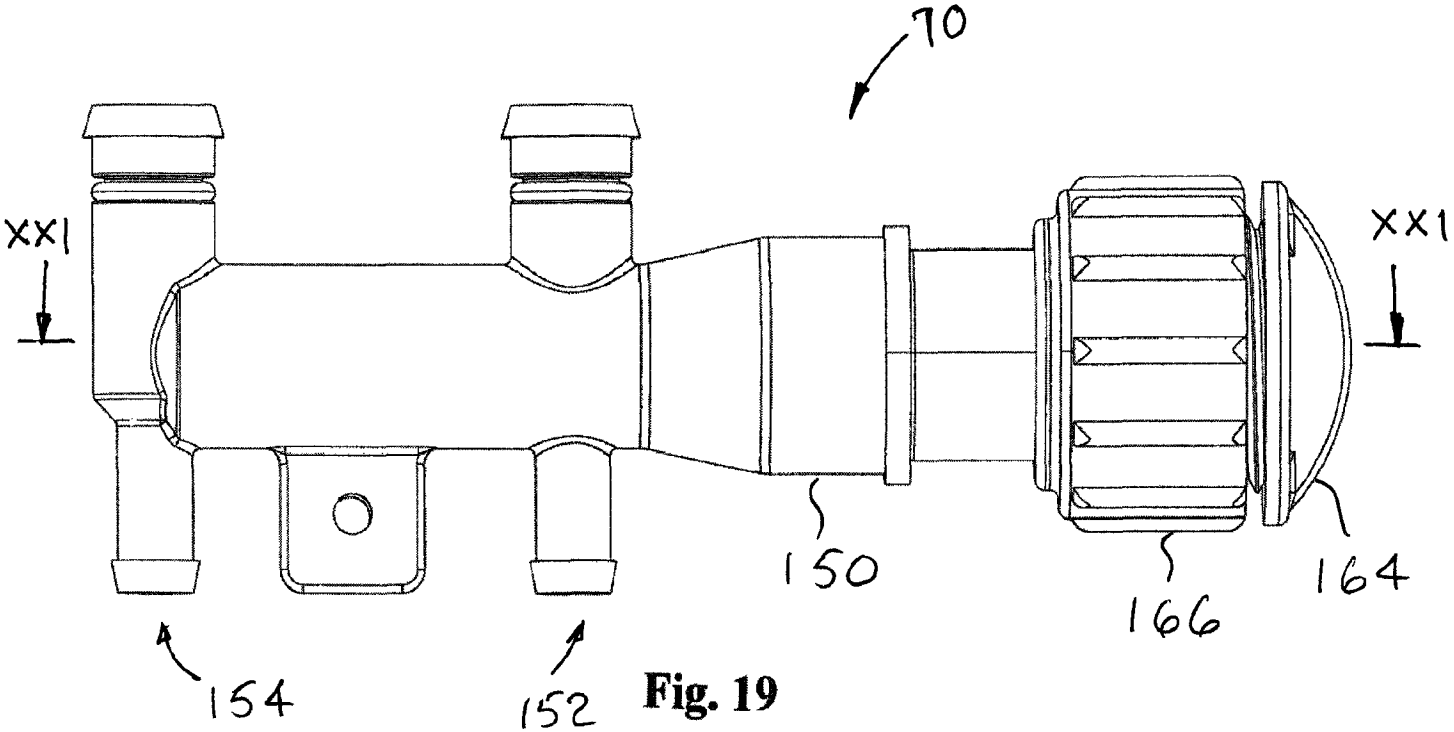
FIG. 19 is a side elevation view of an overpressure relief valve that may be useful in the practice of the present invention.
Figure 20:
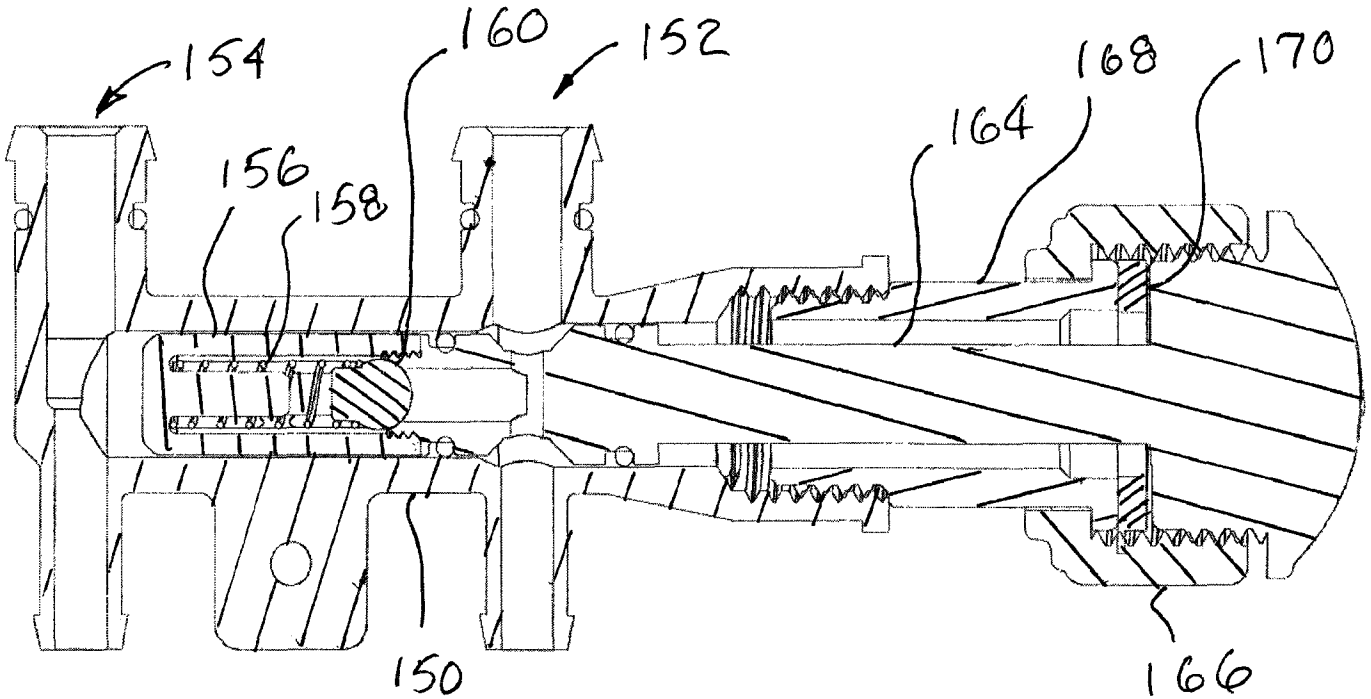
FIG. 20 is a side elevation section view of the overpressure relief valve shown in FIG. 19, taken as indicated by line XX-XX of FIG. 21.
Figure 21:
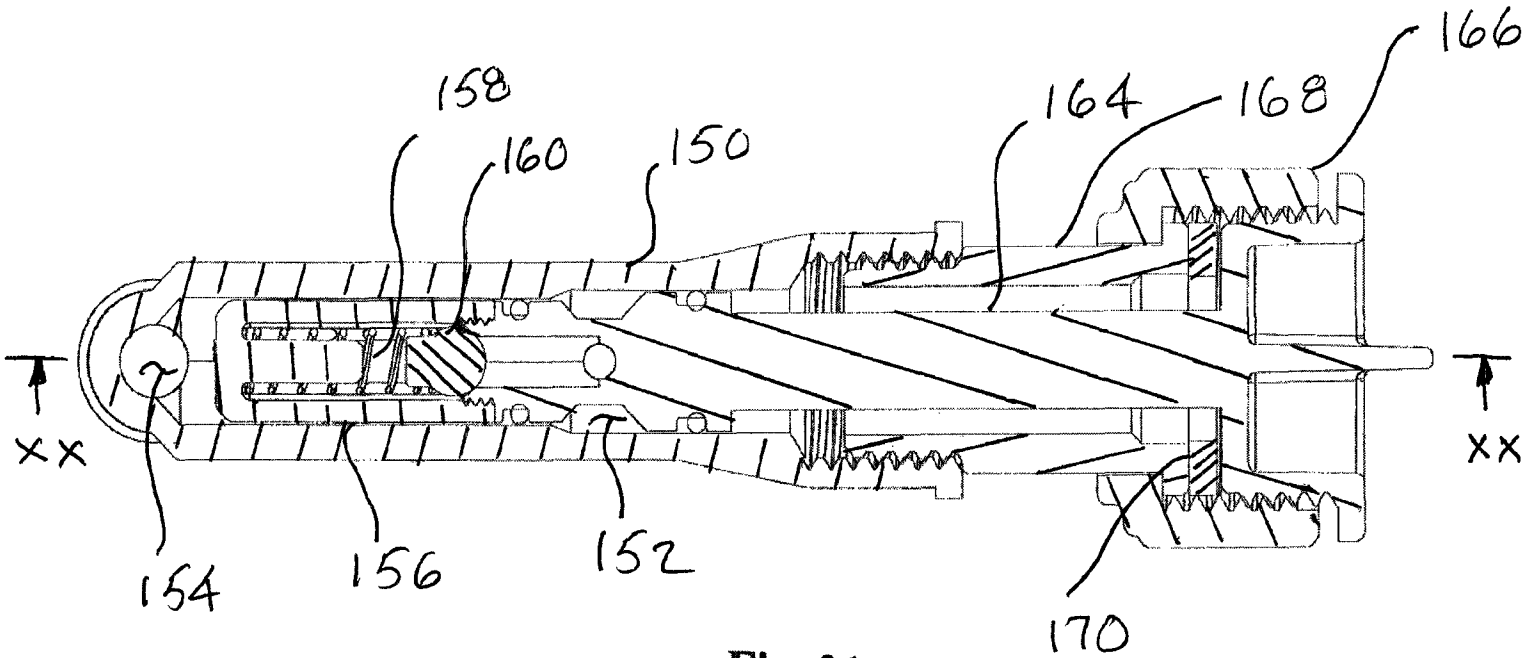
FIG. 21 is a top plan section view of the overpressure relief valve taken along line XXI-XXI of FIG. 19.
Figure 22:
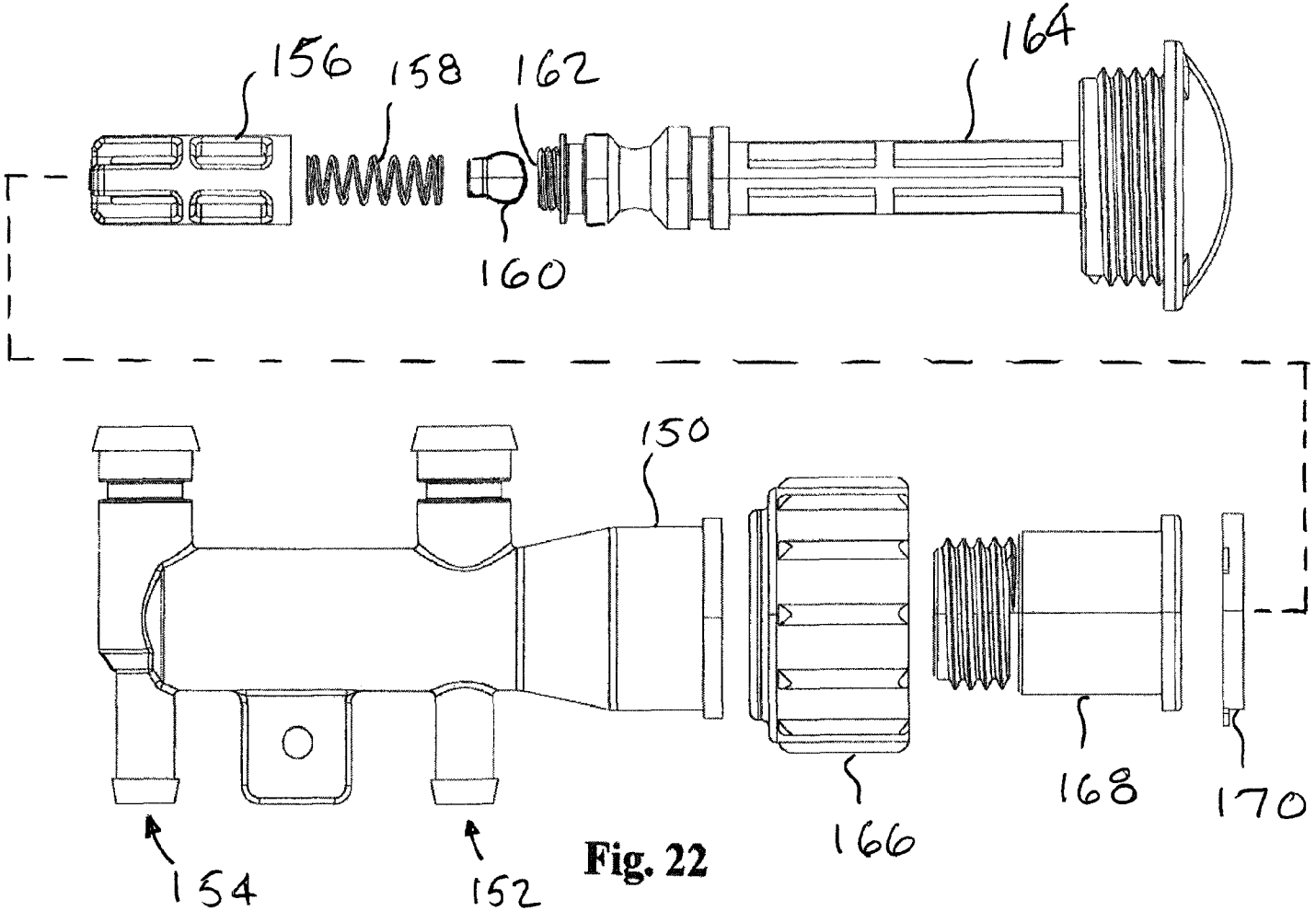
FIG. 22 is an exploded side view of the overpressure relief valve shown in FIG. 19.
Figure 23:
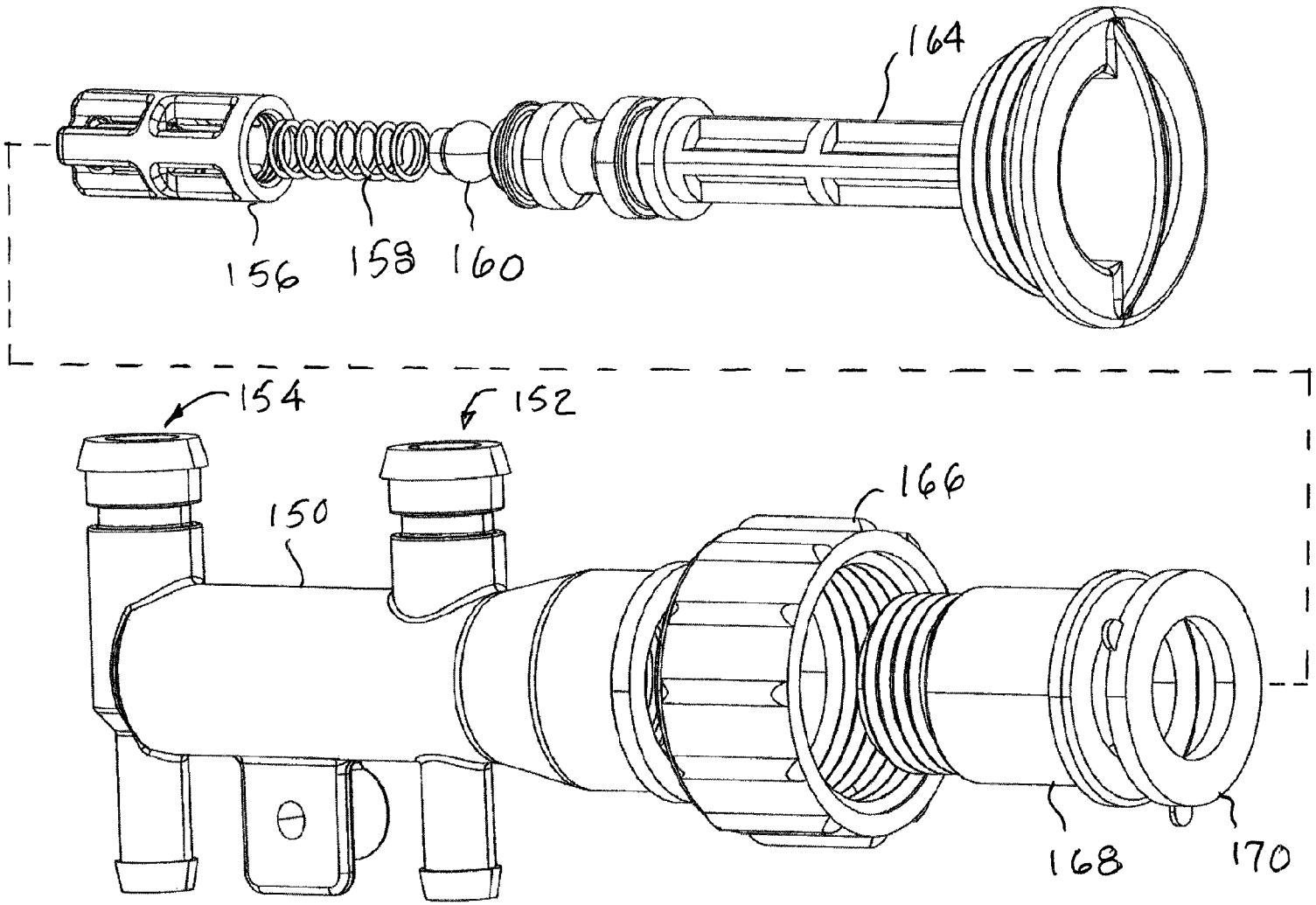
FIG. 23 is a view similar to that of FIG. 22, except shown from the side and one end.

Referring now to FIG. 18, a simplified electrical schematic for the system 10 of the present invention may be seen. Dashed box 56 represents gun 12, while dashed box 58 represents pump 14, it being understood that any type of pump may be used with this invention, provided that the pump has sufficient head pressure to deliver the paint to the regulator in normal operation. The E-I lamination motor is represented by circle 60, and trigger 26 is used to actuate switch 62 in the gun 12. Circle 64 represents a motor driving pump 38. A double-pole, double throw switch 66 may be used to choose between a SPRAY and a CLEAN operation. A conventional grounded electrical plug 68 may be used to connect the system to a source of electrical power, typically 115 VAC, single phase.

Referring now to FIGS. 19-23, in addition to the regulator 48, in the practice of the present invention an overpressure relief valve 70 may be included in the flow path from the feed pump outlet 44 to limit the amount of pressure present in the paint delivery tube 22. Valve 70 includes a housing 150 with a high pressure side 152 and a low pressure side 154. A cage 156 supports a spring 158 urging a ball-like valve member 160 against a seat 162. Seat 162 may be formed integrally with a stem 164 which is removable for cleaning. A garden hose coupling 166 is held to housing 150 by a retainer 168 which allows the coupling to turn when the stem 164 is removed. A washer 170 seals the stem 164 during operation, and alternatively, seals against a garden hose (not shown) during cleaning.

The operation of the regulator is as follows. Referring now again to FIG. 12, the regulator is in an operating condition for the SPRAY mode, but without any demand for paint being called for from the gun 1 via suction or vacuum in the inlet 50 of the piston rod housing 46. At this time, the tapered stopper 132 seals via O-ring 136 against the throat 146 of the regulator housing 90, and no paint is delivered to the gun 1 by the regulator 48. Once the gun 1 is activated by pulling the trigger 26, the piston rod 7 will be reciprocated in the cylinder 6, causing a vacuum to develop at the inlet 50 and in the diaphragm chamber 92.

Figure 13:
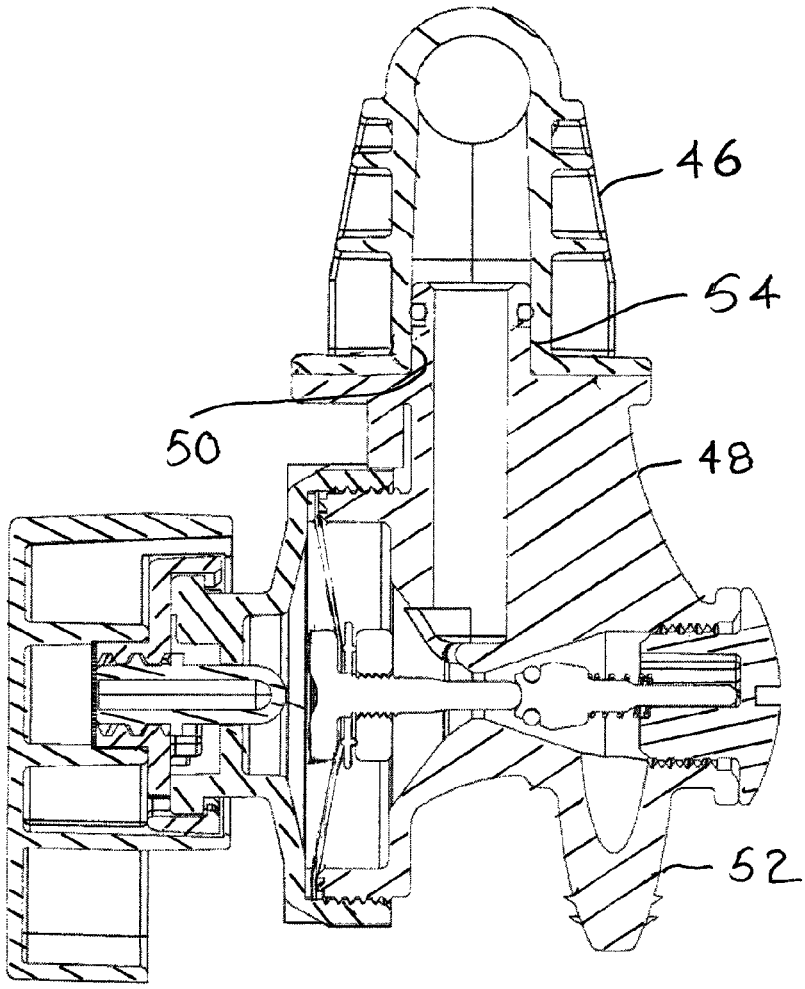
FIG. 13 is a second vertical section view similar to that shown in FIG. 12, except taken along a plane indicated by line XXIII-XXIII of FIG. 10, with parts shown in a second position corresponding to a SPRAY mode with a vacuum demand on the regulator.

Referring now to FIG. 13, the vacuum in diaphragm chamber 92 will draw the diaphragm 94 to the right and the stem 120 will urge the tapered stopper away from the throat 146, all as shown in FIG. 13. At this time, the vacuum in the outlet 54 of the regulator 48 will modulate the paint passing from the inlet 52 to the outlet 54 of the regulator. The back relief 134 of the tapered stopper 132 aids in preventing chatter of the diaphragm 94, stem 120 and tapered stopper 132 as they modulate the flow of paint to the gun 1, it being understood that paint at the inlet 52 of the regulator is at a positive pressure, while paint at the outlet 54 will be under a slight vacuum. The above described operation is for the SPRAY mode of the system.

Figure 14:
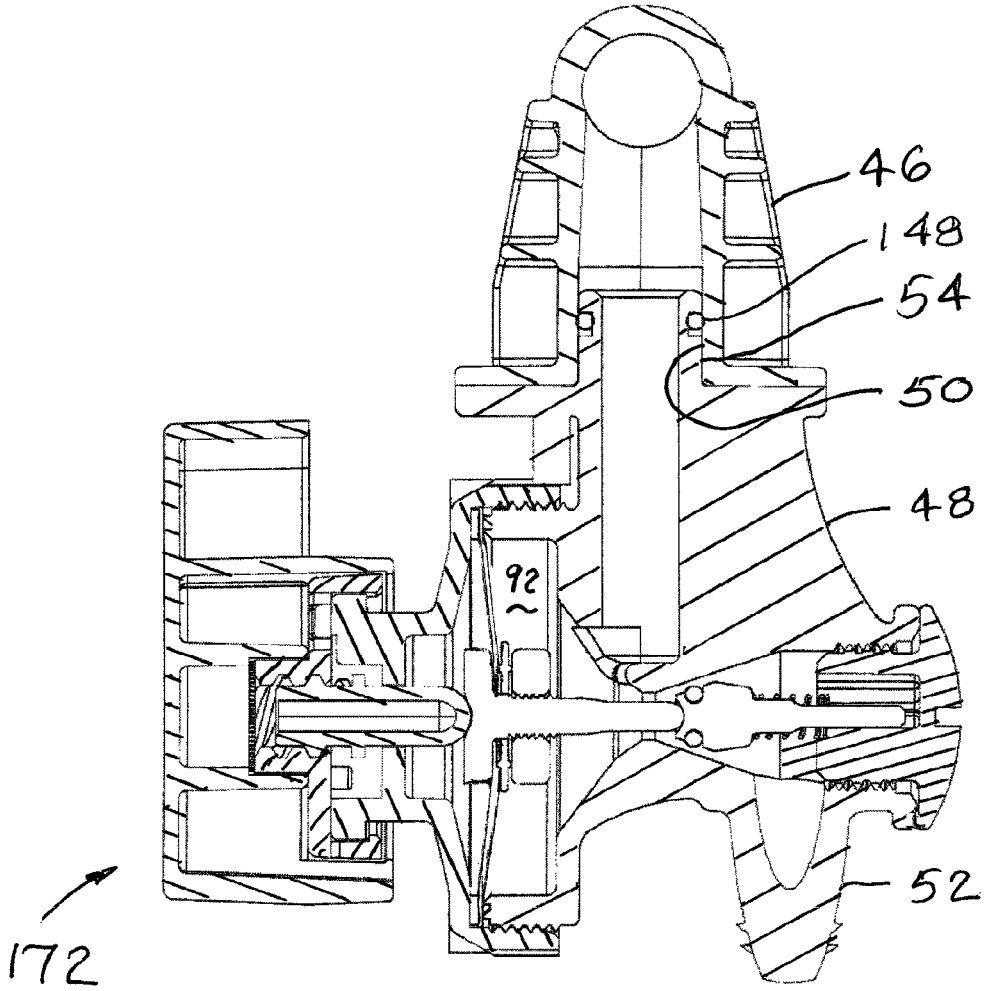
FIG. 14 is a third vertical section view similar to that shown in FIG. 13, except taken along a plane indicated line XIV-XIV of FIG. 10, with parts shown in a third position corresponding to a CLEAN mode.
Figure 15:
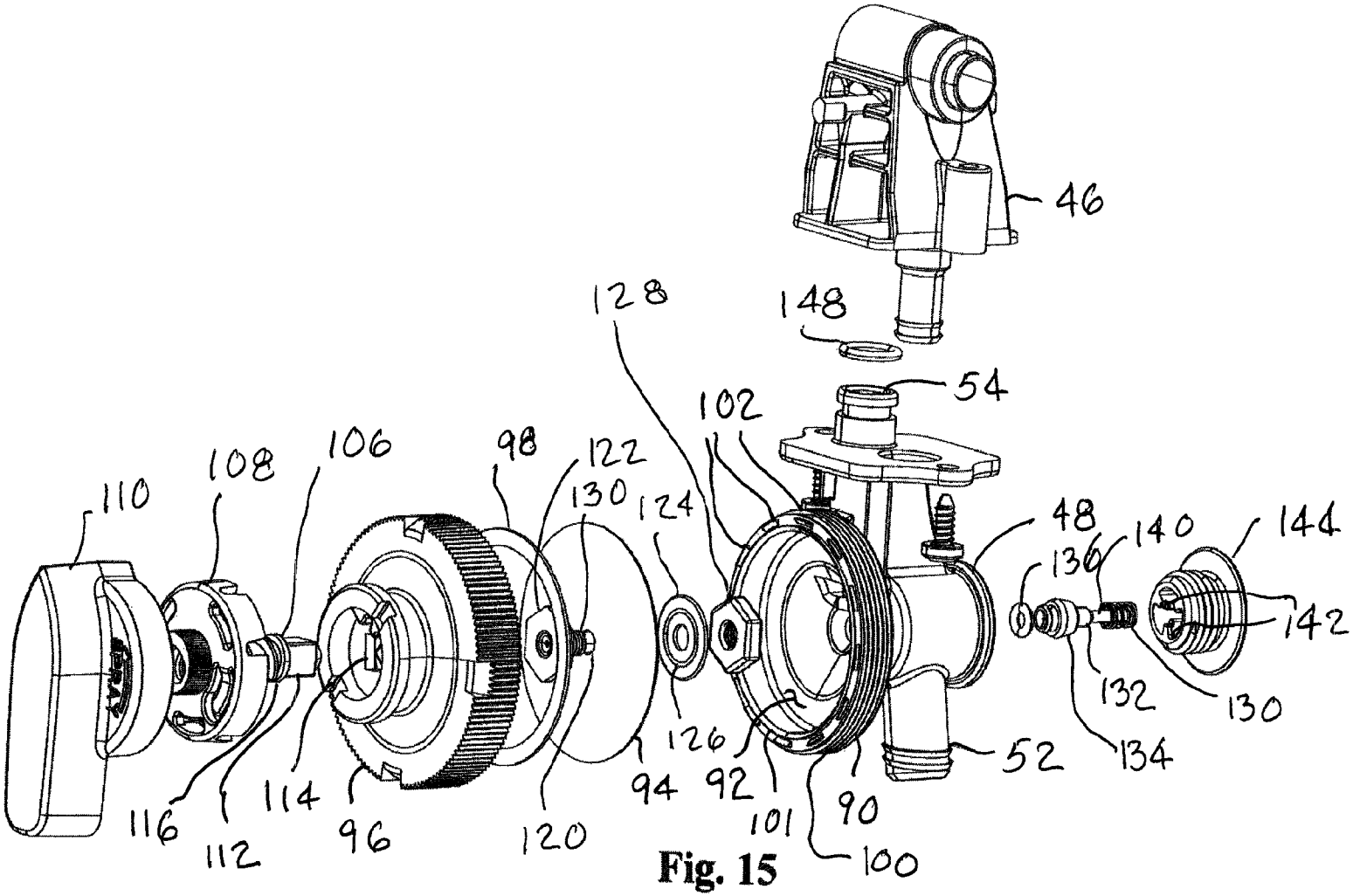
FIG. 15 is a first exploded view of the piston rod housing and paint regulator of FIG. 10 shown from a forward angle.
Figure 16:
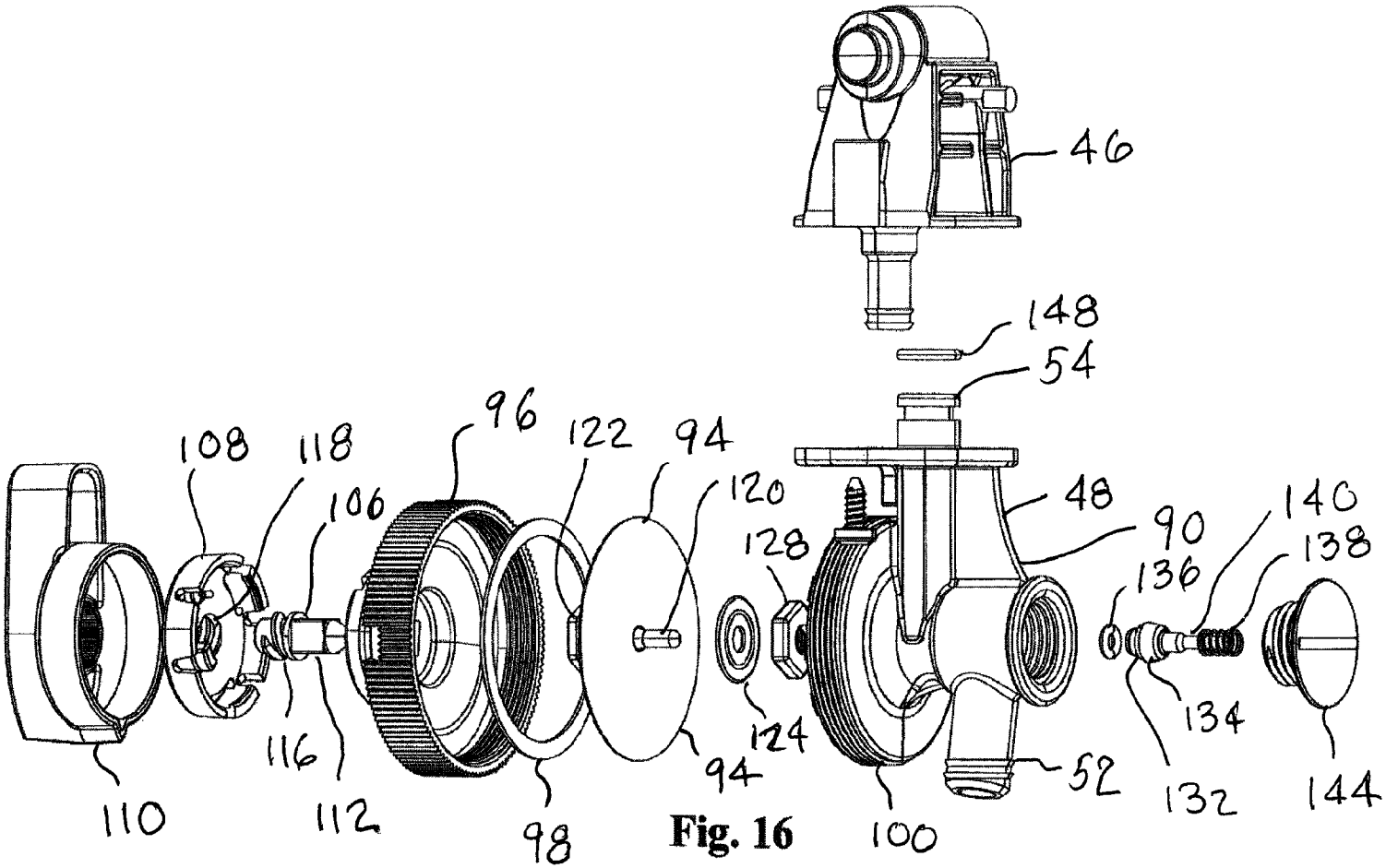
FIG. 16 is a second exploded view of the parts shown in FIG. 15, except from a rearward angle.
Figure 17:
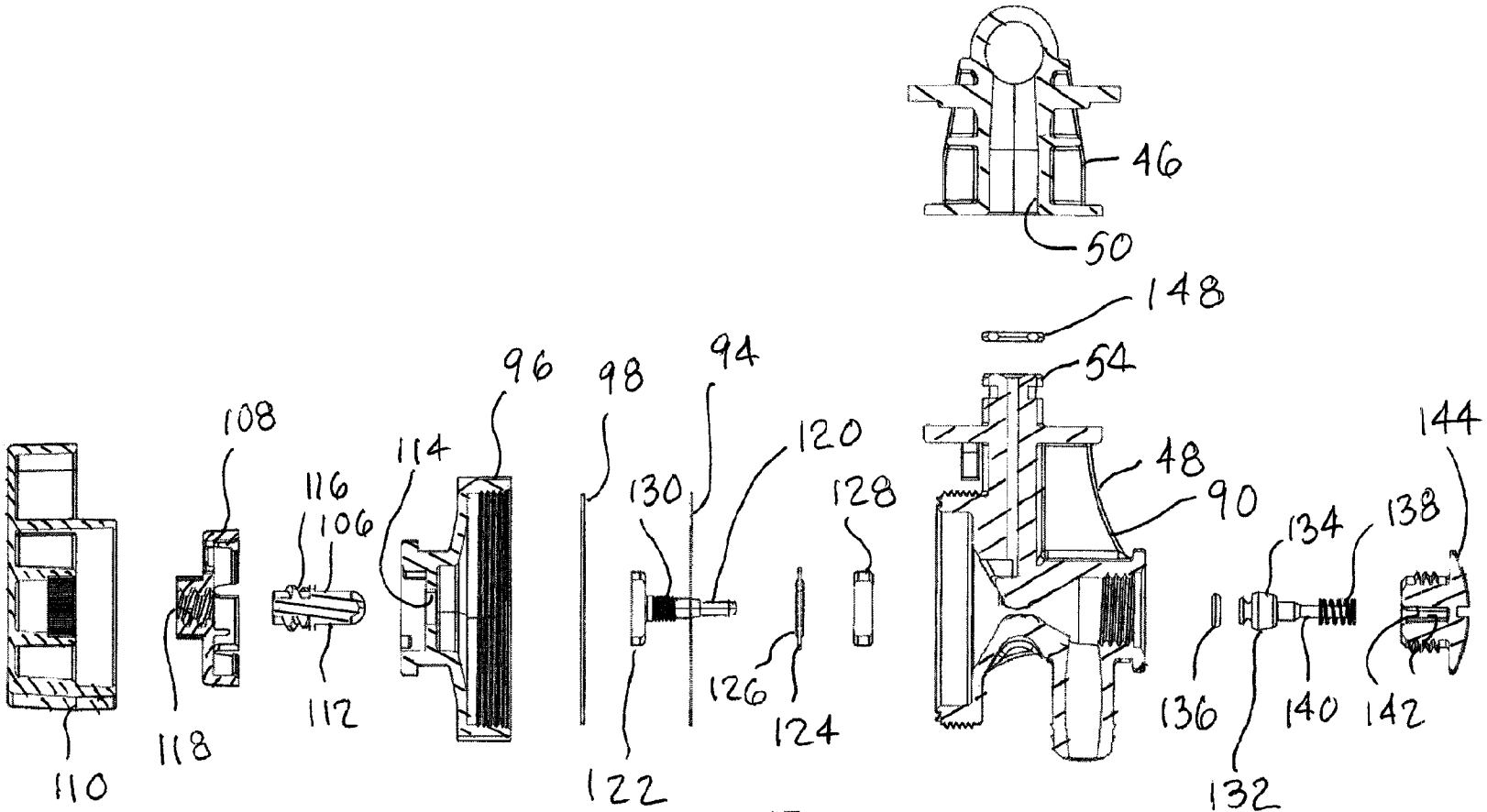
FIG. 17 is a third exploded view in side elevation of the parts shown in FIG. 15, with parts shown in section taken along a plane indicated by line XVII-XVII of FIG. 10.

Referring now to FIG. 14, when it is desired to operate the system in the CLEAN mode, the knob 110 is turned to a CLEAN position 172, as shown in FIG. 14. This rotation of knob 110 will rotate the adjusting ring 108 and advance the pressure finger 106 via threads 118 acting on threaded portion 116 of the finger 106. Finger 106 is prevented from rotating because of the non-circular cross sectional engagement between region 112 on finger 106 and the congruent shape of the aperture 114 in cover 96. When finger 106 is advanced in the manner described, it will act on the enlarged head 122 of stem 120 to urge the diaphragm 94 to the right as shown in FIG. 14, unseating the tapered stopper 132 from throat 146 to allow cleaning water supplied via the feed tube 42 to pass through the parts of the pump and gun which were in contact with paint during the SPRAY mode, to clean all such parts during the CLEAN mode. Electrical switch 66 energizes the pump 58 without requiring the pump to activate itself, for example, by a pressure switch measuring the fluid pressure at the pump outlet 44.

Referring now again to FIGS. 19-21, the operation of the overpressure valve assembly 70 is as follows. When the pressure in the high pressure side 152 of the valve 70 is below a predetermined pressure (such as 50 psi) the ball member 160 remains against the seat 162. In the event of pressure in the high pressure side of the valve 70 exceeding the predetermined pressure, the ball member 160 will be urged by the fluid pressure away from the seat 162, allowing flow to occur from the high pressure side 152 past the ball member 160 through the cage 156 to the low pressure side 154, where it will may returned to the supply container. Once the pressure in the high pressure side 152 drops to the predetermined pressure (or below) the ball-like valve member 160 will be urged against the seat 162 by the spring 158.

The invention is not to be taken as limited to all of the details thereof as modifications and variations thereof may be made without departing from the spirit or scope of the invention. For example, and not by way of limitation, the paint spray gun may be replaced by another paint applicator which uses vacuum to draw paint to the applicator from the reservoir. Furthermore, other types of pumps for delivering paint from the reservoir may be used while still remaining within the present invention.

What is claimed is:

1. A paint applicator system for applying paint using an applicator connected to a remote paint reservoir, the system comprising:

a paint applicator of the type which draws paint by vacuum for application to a surface to be coated by the paint;

a paint reservoir and pump located remote from the paint applicator and connected thereto by a paint delivery tube, the pump delivering paint at a pressure greater than zero through the delivery tube; and a paint regulator located at the paint applicator and modulating a supply of the paint from the paint delivery tube to a paint compression chamber at a low level of vacuum that is below atmospheric pressure, wherein the paint regulator comprises:

a housing having an inlet configured to receive paint from the paint delivery tube and an outlet configured to supply the paint to the paint compression chamber, a stopper located in the housing between the inlet and outlet and movable between a seated position wherein flow is blocked between the inlet and outlet, and an unseated position wherein flow is permitted between the inlet and outlet, a spring urging the stopper to the seated position, and a diaphragm responsive to a level of vacuum at the outlet of the housing to urge the stopper toward the unseated position.

2. The paint applicator system of claim 1 wherein the paint applicator comprises a hand-held paint spray gun having a piston reciprocating in the chamber to compress paint drawn into the chamber by vacuum, and atomizing the paint drawn into the chamber by driving the paint through a small orifice spray tip.

3. The paint applicator system of claim 1 wherein the pump delivers paint in the paint delivery tube at a pressure greater than zero and less than about 50 pounds per square inch.

4. The paint applicator system of claim 1 wherein the paint regulator modulates the passage of paint from the paint delivery tube to the chamber at a vacuum in a range between zero and about three inches of mercury.

5. The paint applicator system of claim 1 further comprising an overpressure regulator connected between the pump and the paint delivery tube acting to limit the pressure in the paint delivery tube to less than about 50 pounds per square inch.

6. The paint applicator system of claim 1 wherein the pump is a positive displacement pump.

7. The paint applicator system of claim 1 wherein the pump is a peristaltic pump.

8. The paint applicator system of claim 1 further comprising a mechanical selector switch for placing the system in one of a SPRAY and CLEAN mode.

9. The paint applicator system of claim 1 further comprising an electrical selector switch for operating the system in one of a SPRAY and CLEAN mode.

10. The paint applicator system of claim 1 wherein the paint regulator further comprises a knob movable between a first position wherein the stopper is free to respond to the vacuum condition at the outlet of the housing and a second position wherein the stopper is forced to the unseated position.

11. The paint applicator system of claim 1 wherein the stopper has a back relief to prevent chatter as the regulator responds to vacuum to modulate the flow of paint from the inlet to the outlet.

12. The paint applicator system of claim 1 wherein the stopper has an extension engaging the spring.

13. The paint applicator system of claim 12 wherein the regulator further comprises a plurality of fingers guiding the extension as the stopper moves between the seated and unseated positions.

14. The paint applicator system of claim 1 wherein the housing has a plurality of teeth at a periphery of the diaphragm to restrain radially inward movement of the diaphragm in response to an increase in vacuum at the outlet.

* * * * *